US010704328B2

(12) United States Patent
Korf et al.

(10) Patent No.: US 10,704,328 B2
(45) Date of Patent: Jul. 7, 2020

(54) RETENTION SYSTEM FOR BOTTOM HOLE ASSEMBLY AND WHIPSTOCK

(71) Applicant: Weatherford Technology Holdings, LLC, Houston, TX (US)

(72) Inventors: Joshua Matthew Korf, Houston, TX (US); David W. Teale, Spring, TX (US); Thomas Helbert, Magnolia, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 197 days.

(21) Appl. No.: 15/730,455

(22) Filed: Oct. 11, 2017

(65) Prior Publication Data

US 2019/0106940 A1 Apr. 11, 2019

(51) Int. Cl.
*E21B 7/08* (2006.01)
*E21B 7/06* (2006.01)

(52) U.S. Cl.
CPC ..... *E21B 7/061* (2013.01)

(58) Field of Classification Search
CPC ..... E21B 7/061
See application file for complete search history.

(56) References Cited

U.S. PATENT DOCUMENTS

| | | | |
|---|---|---|---|
| 2,506,799 | A | 5/1950 | Livingston |
| 2,567,507 | A | 9/1951 | Brown |
| 2,770,444 | A | 11/1956 | Neal |
| 2,823,012 | A | 2/1958 | Hanna |
| 2,839,270 | A | 6/1958 | McCune et al. |
| 2,978,032 | A | 4/1961 | Hanna |
| 3,000,440 | A | 9/1961 | Malcomb |
| 3,115,935 | A | 12/1963 | Hooton |
| 3,215,204 | A | 11/1965 | Sims |
| 3,339,636 | A | 9/1967 | Frisby |
| 3,477,524 | A | 11/1969 | Marks, Jr. |
| 4,284,136 | A | 8/1981 | Grabe |

(Continued)

FOREIGN PATENT DOCUMENTS

| | | | |
|---|---|---|---|
| RU | 2469172 | C1 | 12/2012 |
| WO | 2015053760 | A1 | 4/2015 |
| WO | 2016209686 | | 12/2016 |

OTHER PUBLICATIONS

PCT International Search Report and Written Opinion dated Jan. 2, 2019, for International Application No. PCT/US2018/055299.

*Primary Examiner* — Robert E Fuller
(74) *Attorney, Agent, or Firm* — Patterson + Sheridan, LLP

(57) ABSTRACT

Methods and apparatus for releasing a lead mill of a BHA from a whipstock in a wellbore include slideably releasing the BHA from the whipstock without relative rotation and without destruction of a retractable bolt. A system includes: a bias mechanism; a retractable bolt at least partially disposed in the bottom hole assembly and biased to a retracted position by the bias mechanism; and a retraction actuator capable of selectably opposing the bias of the retractable bolt. A method includes: coupling a whipstock to a BHA with a retention system, including: a retractable bolt biased to retract into the BHA; and a retraction actuator configured to resist the bias of the retractable bolt; and after the whipstock and BHA have been disposed in a wellbore, activating the retraction actuator so that retraction of the retractable bolt ensues.

34 Claims, 9 Drawing Sheets

(56) References Cited

U.S. PATENT DOCUMENTS

| | | | | |
|---|---|---|---|---|
| 4,928,767 | A | 5/1990 | Jelsma | |
| 4,984,632 | A | 1/1991 | Sampa et al. | |
| 5,467,819 | A | 11/1995 | Braddick | |
| 5,678,634 | A | 10/1997 | Rehbock et al. | |
| 5,771,972 | A | 6/1998 | Dewey et al. | |
| 5,816,324 | A | 10/1998 | Swearingen et al. | |
| 5,894,889 | A | 4/1999 | Dewey et al. | |
| 6,102,123 | A | 8/2000 | Bailey et al. | |
| 6,302,198 | B1 | 10/2001 | Ritorto et al. | |
| 6,318,466 | B1 | 11/2001 | Ohmer et al. | |
| 6,374,918 | B2 | 4/2002 | Roberts et al. | |
| 6,464,002 | B1 | 10/2002 | Hart et al. | |
| 6,591,905 | B2 | 7/2003 | Coon | |
| 6,695,056 | B2 | 2/2004 | Haugen et al. | |
| 6,910,538 | B2 | 6/2005 | Tinker | |
| 6,939,073 | B1 | 9/2005 | Ahmed et al. | |
| 6,968,903 | B2 | 11/2005 | Pollard | |
| 7,083,010 | B2 | 8/2006 | Eppink et al. | |
| 7,201,529 | B2 | 4/2007 | Lejeune | |
| 7,264,059 | B2 | 9/2007 | Akselberg | |
| 7,353,867 | B2 | 4/2008 | Carter et al. | |
| 7,699,112 | B2 | 4/2010 | Galloway | |
| 7,878,253 | B2 | 2/2011 | Stowe et al. | |
| 7,963,341 | B2 | 6/2011 | Rios, III et al. | |
| 8,327,944 | B2 | 12/2012 | King et al. | |
| 8,469,096 | B2 | 6/2013 | McGarian | |
| 8,833,442 | B2 | 9/2014 | Ibragimov et al. | |
| 9,004,159 | B2 | 4/2015 | Alsup et al. | |
| 2002/0170713 | A1 | 11/2002 | Haugen et al. | |
| 2014/0332277 | A1* | 11/2014 | Churchill | E21B 21/103 175/57 |
| 2016/0238055 | A1* | 8/2016 | Donovan | F16B 31/021 |
| 2019/0003264 | A1* | 1/2019 | Swadi | E21B 7/061 |

* cited by examiner

RETENTION SYSTEM FOR BOTTOM HOLE ASSEMBLY AND WHIPSTOCK

BACKGROUND

Field

Embodiments of the present disclosure generally relate to systems and methods for releasing a lead mill of a bottom hole assembly from a whipstock in a wellbore. In embodiments, the bottom hole assembly slideably releases from the whipstock without relative rotation and/or without destruction of a retractable bolt.

Description of the Related Art

In well completion operations, a wellbore is formed by drilling to access hydrocarbon-bearing formations. After drilling to a predetermined depth, the drill string and drill bit are removed, and a section of casing (or liner or pipe or tubular) is lowered into the wellbore. An annular area is formed between the drill string of casing and the formation, and a cementing operation may then be conducted to fill the annular area with cement. At times, drilling and casing operations may follow one after the other, requiring multiple removals and replacements of equipment in the wellbore ("trips"). Additional trips increase the costs and risks associated with a well completion operation.

In some operations, for example, in a highly deviated wellbore (e.g., high inclination, extended horizontal reach, or multiple directional changes), the well completion operation may include a sidetracking operation that changes the direction of the wellbore, and consequently the direction of the drill string and casing. Traditionally, a whipstock having a concave face is anchored at the turning point. The orientation of the concave face obstructs the wellbore in the first direction, causing the drill bit to turn and drill in the second direction. To appropriately direct the drill string and casing, the whipstock must be secured in the wellbore (anchored) at the selected depth and in the selected direction (orientation).

The sidetracking turn may require milling through previously deployed casing. In order to reduce the number of trips required, a lead mill has been secured to a whipstock with a retention system, such as a shear bolt (e.g., a hardened steel bolt). The whipstock can be anchored, then weight put on the drill string to shear the shear bolt, and then the lead mill can be employed to mill the casing at the turn. (Alternatively, the shear bolt may be sheared by applying a pulling and/or twisting force to the drill string.) However, the shear bolt presents reliability risks. For example, in highly deviated wellbores, the drill string may encounter extremely high frictional forces. Overcoming the frictional forces when deploying the lead mill and whipstock can exceed the shear pressure of the shear bolt prematurely, placing the whipstock incorrectly in the wellbore. Alternatively, even when the whipstock is correctly positioned, the frictional forces may prevent weight on the drill string from being transferred to the shear bolt appropriately to release the lead mill from the whipstock.

New systems and methods for operationally securing and releasing a lead mill of a bottom hole assembly from a whipstock would reduce risks and costs of casing operations.

SUMMARY

The present disclosure generally relates to systems and methods for releasing a lead mill of a bottom hole assembly from a whipstock in a wellbore. In embodiments, the bottom hole assembly slideably releases from the whipstock without relative rotation and without destruction of a retractable bolt.

In an embodiment, a retention system for a bottom hole assembly and a whipstock includes: a bias mechanism; a retractable bolt at least partially disposed in the bottom hole assembly and biased to a retracted position by the bias mechanism; and a retraction actuator capable of selectably opposing the bias of the retractable bolt.

In an embodiment, a retention system for a bottom hole assembly and a whipstock includes: a retractable bolt at least partially disposed in the bottom hole assembly, wherein the retractable bolt moves without destruction during operation; a retraction actuator capable of selectably opposing a retraction force on the retractable bolt; and meshing features on the bottom hole assembly and the whipstock, wherein the meshing features slideably mesh and slideably release without rotation between the bottom hole assembly and the whipstock.

In an embodiment, a downhole system includes: a whipstock; a bottom hole assembly proximate a lower end of a drill string; and a retention system, wherein: when the downhole system is in a first operational configuration, the retention system secures the whipstock to the bottom hole assembly with an axial load coupling component and a torsional load coupling component; when the downhole system is in a second operational configuration, the retention system secures the whipstock to the bottom hole assembly with the torsional load coupling component, but not the axial load coupling component; and when the downhole system is in a third operational configuration, the retention system does not secure the whipstock to the bottom hole assembly.

In an embodiment, a method of milling a casing includes: coupling a whipstock to a bottom hole assembly with a retention system, the retention system including: a retractable bolt biased to retract into the bottom hole assembly; and a retraction actuator configured to resist the bias of the retractable bolt; and after the whipstock and the bottom hole assembly have been disposed in a wellbore, activating the retraction actuator so that a retraction of the retractable bolt ensues.

In an embodiment, a method of milling a casing includes: coupling a whipstock to a bottom hole assembly, the bottom hole assembly having a retractable bolt, the coupling comprising: engaging recesses of a mill face of the bottom hole assembly with protrusions of the whipstock; and selectably opposing a retraction of the retractable bolt; and activating the retraction of the retractable bolt after the whipstock and the bottom hole assembly have been disposed in a wellbore, wherein the retractable bolt moves without destruction during the retraction.

In an embodiment, a method of assembling a downhole system includes: attaching a plurality of protrusions to a concave face of a whipstock of the downhole system, wherein: the plurality of protrusions are configured to slideably mesh and slideably release without relative rotation with recesses in a mill face of a bottom hole assembly of the downhole system; and at least two of the plurality of protrusions are at opposing angles to one another.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Embodiments of the present disclosure generally relate to systems and methods for releasing a lead mill of a bottom hole assembly from a whipstock in a wellbore. In embodiments, the bottom hole assembly slideably releases from the whipstock without relative rotation and without destruction of a retractable bolt.

Figure 1:
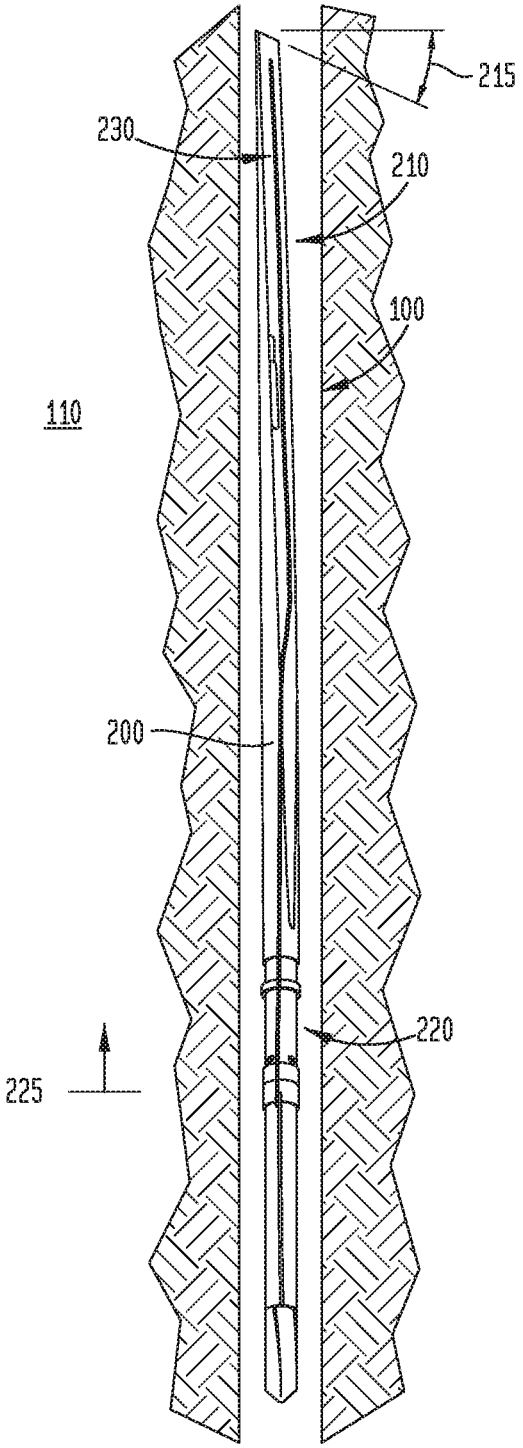
FIG. 1 illustrates a whipstock placed in a wellbore within a subsurface formation.

FIG. 1 illustrates a whipstock 200 placed in a wellbore 100 within a subsurface formation 110, according to embodiments disclosed herein. For the purposes of illustration, the whipstock 200 as shown is neither connected to a drill string nor anchored in the wellbore 100, which may only be a transitory configuration in actual operations. The whipstock 200 has a concave face 210 and a torso 220. In some embodiments, the torso 220 contains, connects to, and/or is contained by an anchoring mechanism for securing whipstock 200 in wellbore 100. For example, several suitable whipstock anchoring mechanisms are disclosed in U.S. Pat. Nos. 6,374,918, 6,591,905, 6,695,056, 7,353,867, and 7,963,341. In some embodiments, the anchoring mechanism is integrated with the whipstock 200. The form of the concave face 210 is generally a surface representing an intersection of a tubular with a plane that is at an angle thereto. In some embodiments, the surface may be primarily concave, while in other embodiments the surface may be primarily flat. The concave face 210 may be most narrow at an upper end. The concave face 210 may be approximately cylindrical at a lower end. The torso 220 may be generally cylindrical, thereby extending from the lower end of the concave face 210. In some embodiments, the whipstock 200 may have a control line 230 that is disposed in, on, or along at least a portion of the length of the concave face 210, at least a portion of the length of the torso 220, and/or along both at least a portion of the length of the concave face 210 and at least a portion of the length of the torso 220. The control line 230 may be a component of a retention system (discussed below). Suitable control lines 230 include hydraulic lines, pneumatic lines, rigid rods, flexible cables, conductive wires, optical fibers, etc.

For operational purposes, it may be desirable to secure the whipstock 200 in wellbore 100 so that it is positioned at a particular depth 225. As illustrated in FIG. 1, wellbore 100 is shown as being vertical (i.e., locally generally parallel to gravitational force) in subsurface formation 110, but in many circumstances at least a portion of wellbore 100 will not be vertical. Nonetheless, as used herein, "depth" refers to a length along the wellbore 100 measured from the surface. The direction that is locally generally parallel to the wellbore may be referred to as the "axial" direction. Terms such as "up", "down", "top", "bottom", "upper," "lower," etc., should be similarly construed.

For operational purposes, it may be desirable to secure the whipstock 200 so that concave face 210 is oriented at a particular angle 215 relative to wellbore 100. For example, the angle 215 between the center of curvature of the upper end of concave face 210 and the wellbore 100 may help to determine the bit path direction/trajectory during subsequent drilling operations. The angle 215 may be expressed, for example, as a compass measurement or with reference to a clock face.

Figure 2A:
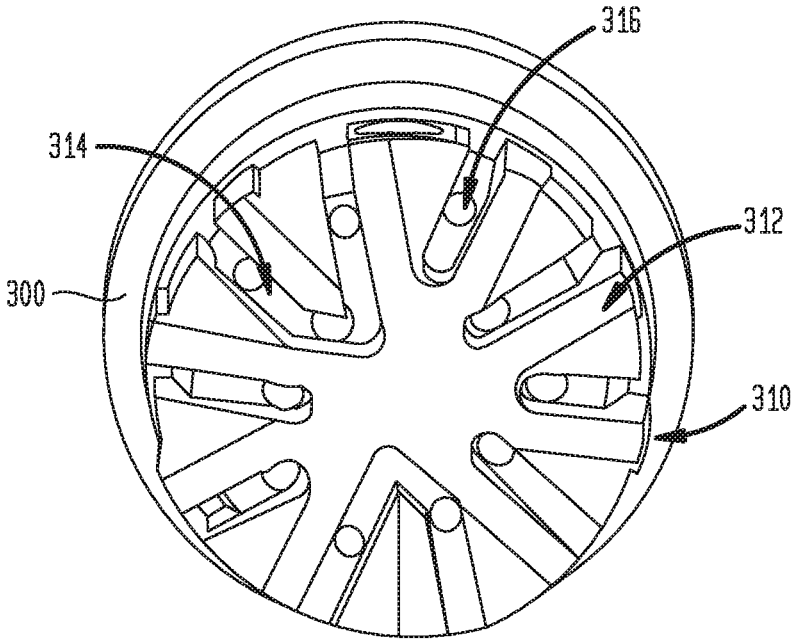
FIG. 2A illustrates a lead mill face at a lower end of a bottom hole assembly.

FIG. 2A illustrates a lead mill face 310 at a lower end of a bottom hole assembly ("BHA") 300, according to embodiments disclosed herein. The BHA 300 may typically be disposed proximate a lower end of a drill string. The mill face 310 may be generally perpendicular to the axial length of the drill string. The mill face 310 may have a generally smaller outer diameter than the BHA 300. One or more projections 312 (e.g. mill blades) may extend axially and/or radially away from mill face 310. (As used herein, "radial" and "radially" should be understood to mean a direction perpendicular to the axial direction. In many instances, "radial" or "radially" may be along a radius, i.e., crossing the center axis of the referenced BHA, mill face, or borehole, However "radial" and "radially" may also refer to a chord that does not cross through the center axis.) The projections 312 may be separated by recesses 314 (e.g., water channels). In some embodiments, the mill face 310 may include additional features, such as holes 316 in one or more of the recesses 314. It should be appreciated that mill blades may be disposed on and/or around mill face 310 so that a width (measured along a generally circumferential direction) of the blade may typically be more narrow than a length (measured along a generally radial direction) of the blade. Consequently, in some embodiments, the circumference of the BHA at the mill face 310 may appear to be a series of alternating projections 312 and recesses 314. The projections 312 may be at opposing angles (i.e., lengths are not parallel) to one another on mill face 310. Some or all of projections 312 may have lengths that are not parallel to any radius (i.e, crossing the center axis) of mill face 310. In some embodiments, the radial extent of the projections 312 may be greater than the radius of the mill face 310. In some embodiments, the radial extent of the projections 312 may be less than the radius of the BHA 300.

Figure 2B:
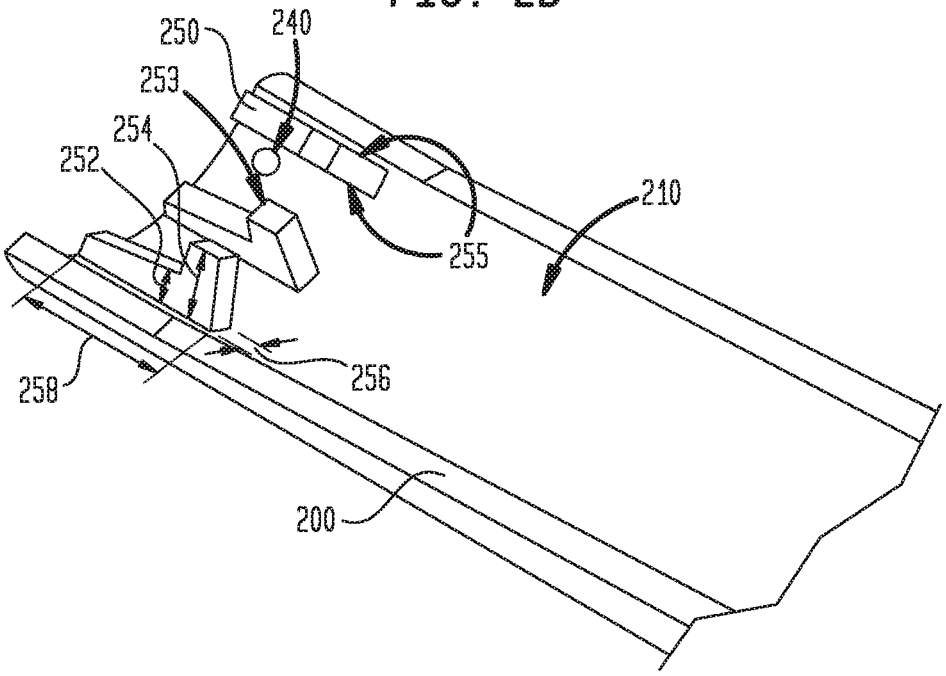
FIG. 2B illustrates an upper end of a concave face of a whipstock.

FIG. 2B illustrates an upper end of a concave face 210 of a whipstock 200, according to embodiments disclosed herein. As illustrated, several protrusions 250 (e.g., dogs) are disposed on the interior of concave face 210 at, proximate, or near to the upper end thereof. The number, shape, orientation, and/or position of the protrusions 250 are selected to slideably mesh with features (e.g., projections 312, recesses 314, holes 316) of mill face 310 when the BHA 300 is mated with the whipstock 200. As such, protrusions 250, projections 312, recesses 314, and holes 316 may be referred to as "meshing features." For example, in the embodiment illustrated in FIG. 1, protrusions 250 may be located proximate the upper end of concave face 210. In some embodiments, two or more protrusions 250 may be disposed on the interior of concave face 210. In some embodiments, wherein only one protrusion 250 is disposed on the interior of concave face 210, the protrusion 250 may include a curve, hook, or angle in a generally radial direction. In order to mesh with projections 312, the protrusions 250 may be at opposing angles to one another. In order to mesh with projections 312, some or all of protrusions 250 may not be parallel to any radius (i.e, crossing the center axis) of concave face 210. FIG. 2B also illustrates a bolt hole 240. The protrusions 250 and bolt hole 240 may be components of the retention system (discussed below).

As illustrated, each protrusion 250 has a first radial depth 252, a second radial depth 254, a width 256, and a length 258. First radial depth 252 is selected to extend each protrusion 250 from the outer diameter of the BHA 300 to the outer diameter of the mill face 310 when the BHA 300 is mated with the whipstock 200. The second radial depth 254 is selected to extend each protrusion 250 from the outer diameter of BHA 300 to an interior of mill face 310 (e.g., between projections 312) when the BHA 300 is mated with the whipstock 200. The width 256 is selected to generally fill the space between projections 312 (e.g., about the same as the width of a recess 314) when the BHA 300 is mated with the whipstock 200. The length 258 is selected to extend each protrusion 250 from above mill face 310 to approximately the bottom of the projections 312 when the BHA 300 is mated with the whipstock 200. Protrusions 250 may have one or more load surfaces. For example, the illustrated protrusions 250 have an axial load surface 253 where the protrusion 250 extends from the first radial depth 252 to the second radial depth 254. When the BHA 300 is mated with the whipstock 200, axial load surface 253 may contact and/or engage the bottom of mill face 310 within a recess 314. Axial load surfaces 253 may thereby provide a downhole axial load coupling from BHA 300 to whipstock 200. As another example, the illustrated protrusions each have two torsional load surfaces 255, which are generally perpendicular to axial load surface 253 and concave face 210. When the BHA 300 is mated with the whipstock 200, torsional load surfaces 255 may contact and/or engage sides of projections 312. Torsional load surfaces 255 may thereby provide a torsional load coupling between BHA 300 and whipstock 200. Not shown in FIG. 2B, protrusions 250 may have one or more load surfaces (e.g., domes) that may contact and/or engage holes 316 and/or other features of mill face 310 when the BHA 300 is mated with the whipstock 200. Protrusions 250 may be spaced to slideably contact, engage, and/or mesh with features of mill face 310. For example, when BHA 300 slides (without significant rotation) axially towards whipstock 200, projections 312 and recesses 314 may contact, engage, and/or mesh with protrusions 250. Likewise, once mated, when BHA 300 slides (without significant rotation) axially away from whipstock 200, projections 312 and recesses 314 may disengage and/or release from protrusions 250. As would be understood by one of ordinary skill in the art with the benefit of this disclosure, meshing features may be designed within standard tolerances and/or with tapered ends. Consequently, to "engage," such features may come into partial and/or transitory contact with one another sufficient to transfer force therebetween.

The number, shape, orientation, and/or position of the protrusions 250 are selected to mesh with features of mill face 310 when the BHA 300 is mated with the whipstock 200. Protrusions 250 may be formed of a material that is softer than the material of projections 312. Protrusions 250 may be formed of a material that is softer than the material of whipstock 200. Protrusions 250 may be attached, bonded, adhered, glued, welded, and/or otherwise connected to whipstock 200 so that axial, torsional, and/or horizontal load may be transferred between BHA 300 and whipstock 200 before whipstock 200 is secured in wellbore 100. For example, when the BHA 300 is mated with the whipstock 200, downhole axial load on BHA 300 may be transferred to whipstock 200 across axial load surfaces 253. Axial load surfaces 253 may thereby provide a downhole axial load coupling from BHA 300 to whipstock 200. As another example, when the BHA 300 is mated with the whipstock 200, rotation of BHA 300 relative to wellbore 100 may apply torsional load to whipstock 200 across torsional load surfaces 255. Torsional load surfaces 255 may thereby provide a torsional load coupling between BHA 300 and whipstock 200. As another example, when the BHA 300 is mated with the whipstock 200, horizontal motion of BHA relative to wellbore 100 may apply horizontal load to whipstock 200 across torsional load surfaces 255 by virtue of the opposing angles of projections 312 and/or protrusions 250. In some embodiments, wherein only one protrusion 250 is disposed on the interior of concave face 210, horizontal motion of BHA relative to wellbore 100 may apply horizontal load to whipstock 200 across torsional load surfaces 255 by virtue of the curve, hook, or angle of protrusion 250. Torsional load surfaces 255 may thereby provide a horizontal load coupling between BHA 300 and whipstock 200. Protrusions 250 may be attached, bonded, adhered, glued, welded, and/or otherwise connected to whipstock 200 so that protrusions 250 may be removed by BHA 300 (e.g., milled away by blades on mill face 310) after whipstock 200 is secured in wellbore 100. In some embodiments, protrusions 250 may be attached, bonded, adhered, glued, welded, and/or otherwise connected to whipstock 200 during ordinary manufacturing and/or assembly of whipstock 200. In some embodiments, protrusions 250 may be attached, bonded, adhered, glued, welded, and/or otherwise connected to whipstock 200 subsequent to manufacturing and/or assembly of whipstock 200 (e.g., retrofitted).

Figure 3A:
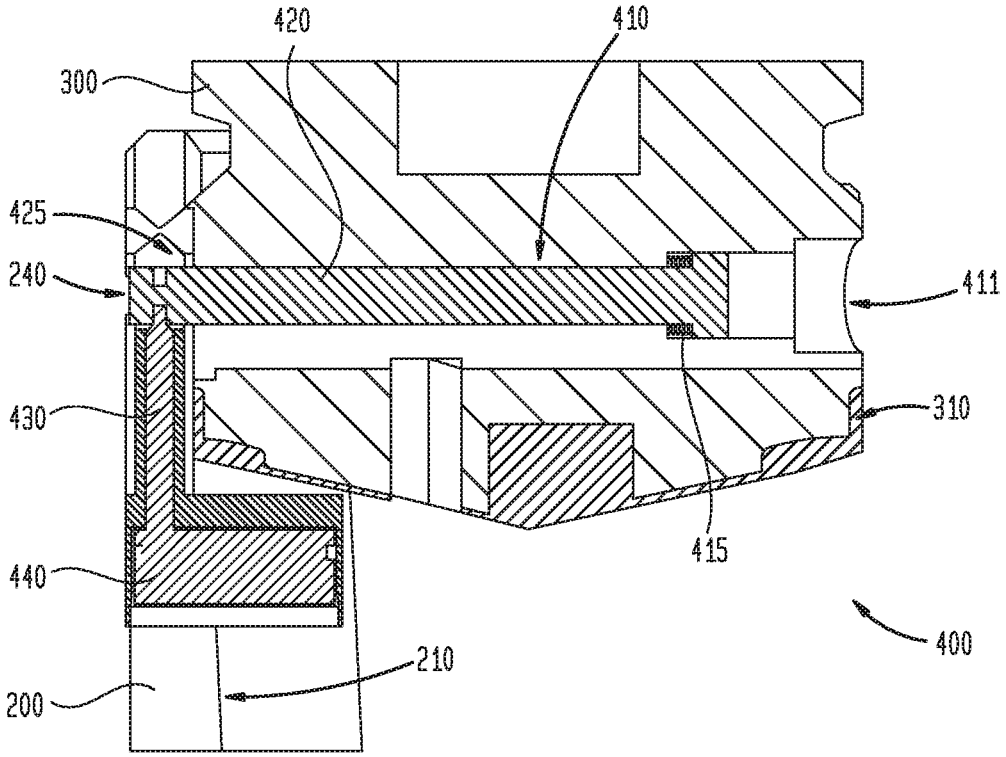
FIG. 3A illustrates an example of a retractable bolt of a retention system.
Figure 3B:
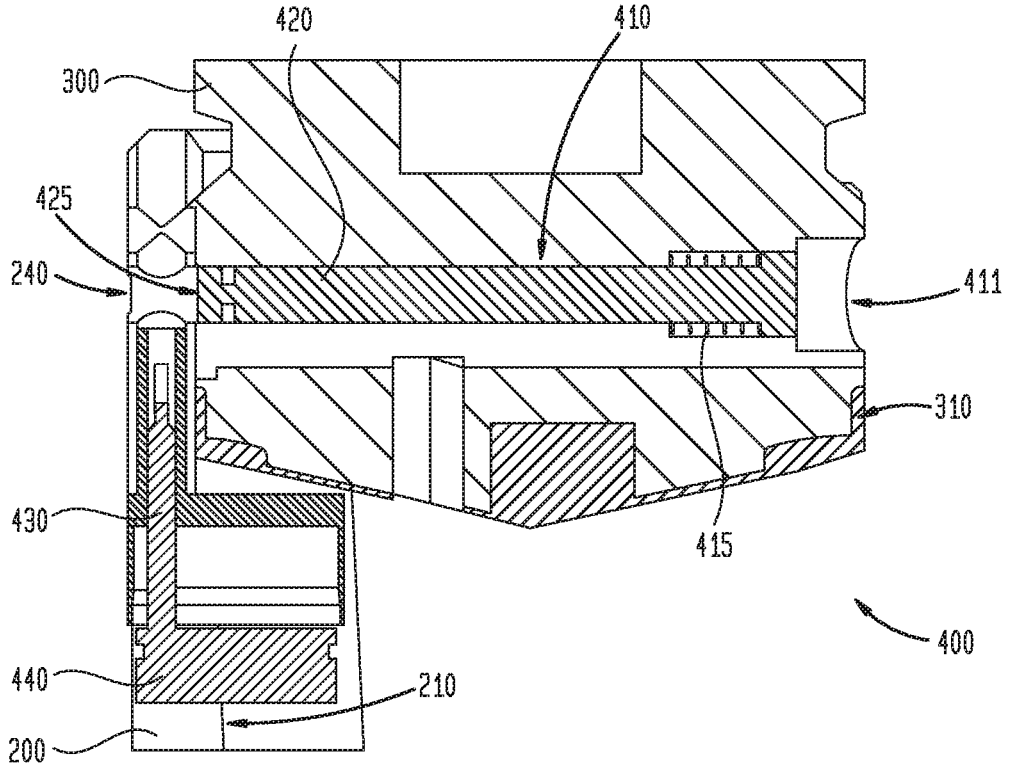
FIG. 3B illustrates another example of a retractable bolt of a retention system.

FIGS. 3A-3B each illustrate an example of a retractable bolt of retention system 400, according to embodiments disclosed herein. As illustrated, a retractable bolt 420 is disposed within a chamber 410 of BHA 300. The chamber 410 may be located proximate to mill face 310. The illustrated chamber 410 is generally parallel to mill face 310, but chamber 410 may be aligned at angles to mill face 310 in other embodiments. Chamber 410 and retractable bolt 420 are configured to allow retractable bolt 420 to move in chamber 410 between a retracted position (see FIG. 3B) and an extended position (see FIG. 3A). In the extended position, a portion 425 of retractable bolt 420 extends outside of the outer diameter of BHA 300 and at least partially into bolt hole 240 of whipstock 200. In the retracted position, portion 425 of bolt 420 does not extend outside of the outer diameter of BHA 300. Retractable bolt 420 is biased to the retracted position. For example, chamber 410 may also include a bias mechanism such as spring 415 to bias retractable bolt 420 to the retracted position. In some embodiments, the bias mechanism may be a magnet or a shaped memory alloy. In some embodiments, the bias mechanism may generate a biasing force with mechanical, electromagnetic, chemical, hydraulic, or pneumatic components. In some embodiments the bias mechanism may be located similarly to spring 415, while in other embodiments the bias mechanism may be located closer to bolt hole 240 in chamber 410. In some embodiments, retention system 400 includes a plurality of retractable bolts 420. In some embodiments, retractable bolt 420 may be shaped as a pin, a plate, fork, or otherwise shaped to meet manufacturing and/or operational specifications while providing a bolting function and a retraction action. In some embodiments, retractable bolt 420 may be a pin having a circular, triangular, square, hexagonal, or other cross-sectional shape to meet manufacturing and/or operational specifications. In some embodiments, retractable bolt 420 may include a rigid, sturdy material, such as metal, alloy, composite, fiber, etc., to meet manufacturing and/or operational specifications. In some embodiments, BHA 300 may have an installation mechanism 411 (e.g., installation hole) coupled to chamber 410. Prior to positioning BHA 300 in wellbore 100, installation mechanism 411 may be utilized to install retractable bolt 420 and/or spring 415 in chamber 410 so that retractable bolt 420 is biased to a retracted position. Retractable bolt 420 may move without destruction in chamber 410 between the retracted position and the extended position. For example, retractable bolt 420 does not shear, dissolve, sever, break, fracture, or otherwise degrade during planned operational conditions. As another example, retractable bolt 420 moves without destruction to the retracted position, thereby being fully retained within BHA 300 and/or having no portion extended into whipstock 240 (e.g., into bolt hole 240). In some embodiments, retention system 400 includes a plurality of retractable bolts, wherein at least one of the plurality of retractable bolts is a retractable bolt 420 that moves without destruction during planned operational conditions.

In some embodiments, in lieu of or in addition to the bias mechanism, the BHA 300 has one or more hydraulic (and/or pneumatic) flow paths coupled to chamber 410. The retractable bolt 420 may be configured to be subject to a pressure differential when the flow paths are pressurized. For example, an end of the retractable bolt 420 closest to the whipstock 200 may have a smaller cross-sectional area than an end of the retractable bolt 420 farthest from the whipstock 200. Hydraulic (and/or pneumatic) flow into chamber 410 may cause a pressure differential across the two ends of retractable bolt 420. The pressure differential may cause a retraction force in the same direction as the previously-discussed biasing force.

FIGS. 3A-3B also illustrate an example of a retraction actuator of retention system 400, according to embodiments disclosed herein. As illustrated, the retraction actuator is a pin 430 connected to a piston 440. Pin 430 may be coupled to retractable bolt 420 when retractable bolt 420 is in the extended position. As illustrated, pin 430 extends through a pin hole of retractable bolt 420. In other embodiments, pin 430 may be coupled to retractable bolt 420 by hooks, loops, magnetic couplings, dissolvable couplings, shaped memory alloys, etc., wherein the coupling between pin 430 and retractable bolt 420 maintains retractable bolt 420 in the extended position and/or selectably opposes retraction of the retractable bolt 420. In some embodiments, the retraction actuator may include a plurality of pins 430. Piston 440 may be activated to decouple pin 430 from retractable bolt 420. As illustrated, piston 440 is activated to move downwards (moving from FIG. 3A to FIG. 3B) to decouple pin 430 from retractable bolt 420. Decoupling of pin 430 from retractable bolt 420 allows retractable bolt 420 to retract into chamber 410 (e.g., biased by spring 415). The retraction actuator of retention system 400 thereby actuates the retractable bolt 420 to retract into chamber 410. The retraction actuator of retention system 400 may be activated by a control signal, which may include one or more of a hydraulic signal (e.g., hydraulic piston 440), a pneumatic signal, an electromagnetic signal (e.g., a solenoid), an optical signal, a chemical signal (e.g., to dissolve pin 430), a time-based signal (e.g., an auto-dissolving pin), a thermal signal, an explosive signal, etc.

The number, shape, orientation, and/or position of chamber 410, bolt 420, pin 430, and/or bolt hole 240 may be selected so that axial, and/or torsional load may be transferred between BHA 300 and whipstock 200 before whipstock 200 is secured in wellbore 100. For example, when the BHA 300 is mated with the whipstock 200, uphole axial load and/or downhole axial load on BHA 300 may be transferred to whipstock 200 across bolt 420 in bolt hole 240. As another example, when the BHA 300 is mated with the whipstock 200, rotation of BHA 300 relative to wellbore 100 may apply torsional load to whipstock 200 across bolt 420 in bolt hole 240. Bolt 420 and bolt hole 240 may thereby provide an uphole axial load coupling, a downhole axial load coupling, and/or a torsional load coupling between BHA 300 and whipstock 200.

Figure 4A:
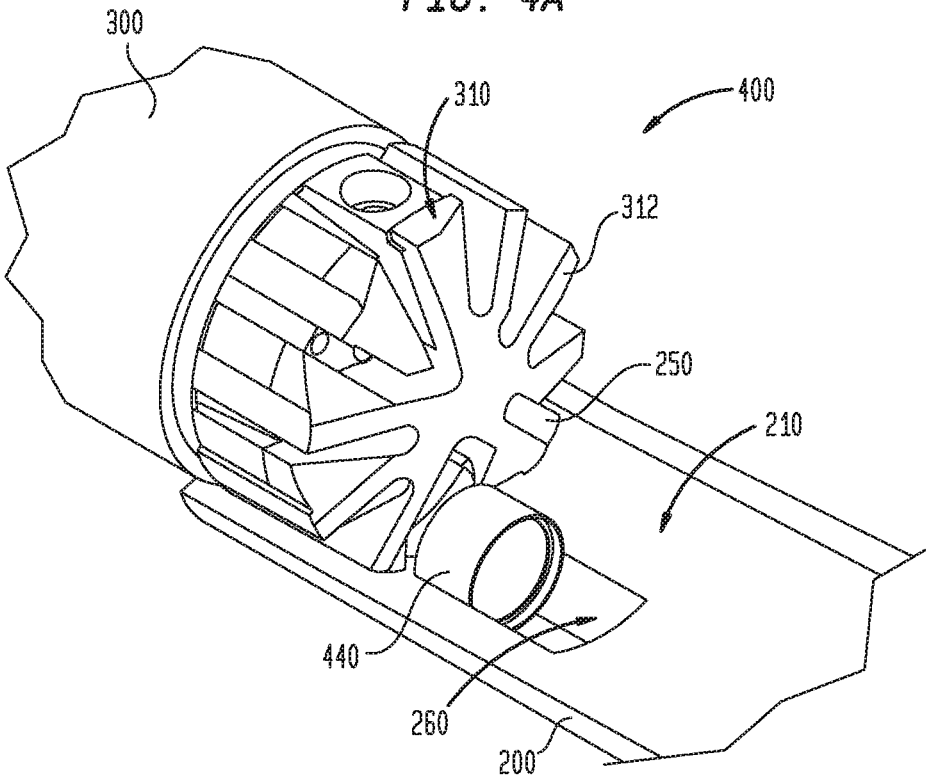
FIG. 4A illustrates an exemplary configuration of a retention system having a piston.
Figure 4B:
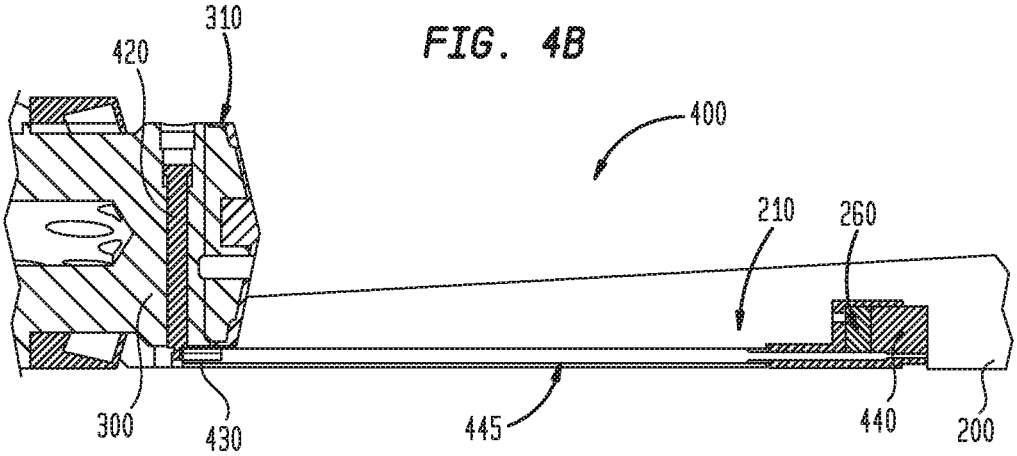
FIG. 4B illustrates another exemplary configuration of a retention system having a piston.
Figure 4C:
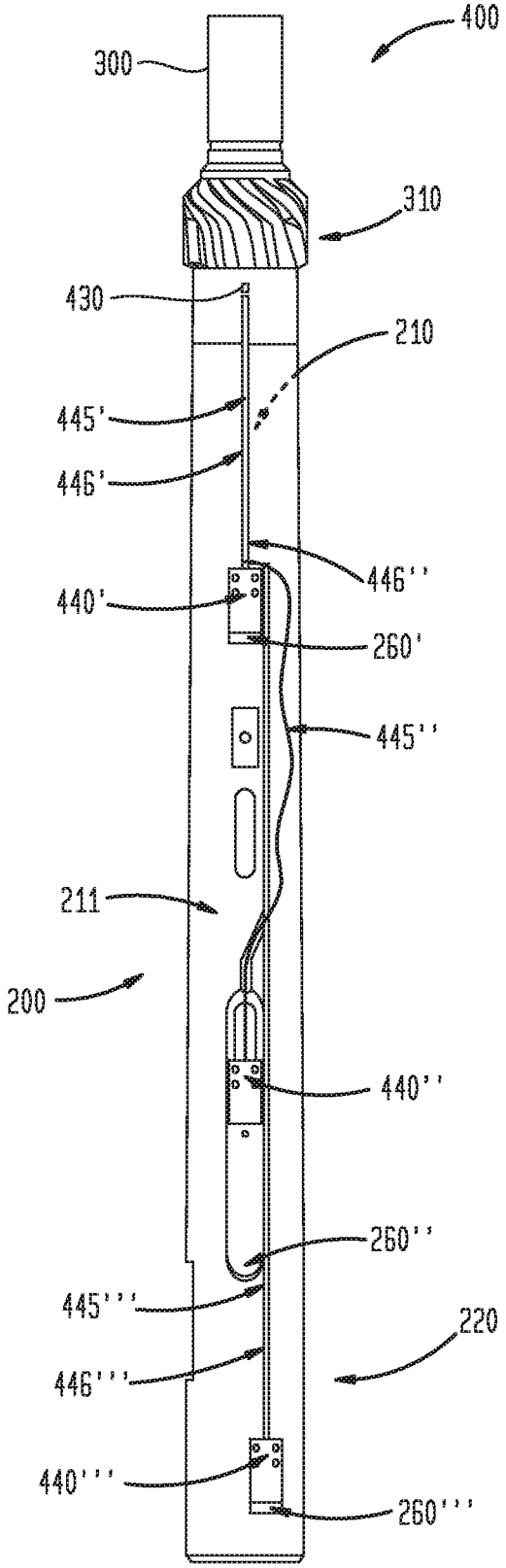
FIG. 4C illustrates additional exemplary configurations of retention systems having pistons.

FIGS. 4A-4C illustrates exemplary configurations of retention systems 400 having pistons 440. Although piston 440 is shown in FIGS. 3A-3B to be close to the retraction actuator (e.g., pin 430), it should be understood that piston 440 may be located elsewhere on whipstock 200. One exemplary configuration of piston 440 is illustrated in FIG. 4A. As shown, piston 440 may move in a track 260 cut into the concave face 210 of whipstock 200. When the BHA 300 is mated with the whipstock 200 such that the mill face 310 contacts and/or engages with the axial load surfaces 253 of protrusions 250, the chamber 410 of BHA 300 may align with bolt hole 240 of whipstock 200 (see FIGS. 3A-3B). Portion 425 of retractable bolt 420 may thereby extend outside of the outer diameter of BHA 300 and at least partially into bolt hole 240 of whipstock 200 (see FIG. 3A). Piston 440 may be positioned at an upper portion of track 260 so that pin 430 couples with retractable bolt 420. Activation of the retraction actuator may move piston 440 to a lower portion of track 260, thereby decoupling pin 430 from retractable bolt 420, allowing retractable bolt 420 to retract into chamber 410. In some embodiments, when mill face 310 contacts and/or engages with the axial load surfaces 253 of protrusions 250, piston 440 may not contact and/or engage with any portion of mill face 310 and/or projections 312.

Another exemplary configuration of piston 440 is illustrated in FIG. 4B. For example, use of actuator extension 445 between piston 440 and the retraction actuator (e.g., pin 430) allows piston 440 to be located proximate the torso 220 of whipstock 200, while the retraction actuator may remain proximate the concave face 210 of the whipstock 200. Suitable actuator extensions 445 include hydraulic lines, pneumatic lines, rigid rods, flexible cables, conductive wires, optical fibers, etc.

In the illustration of FIG. 4B, piston 440 in track 260 is located lower on whipstock 200 than in the illustration of FIG. 4A. In some embodiments, an anchoring mechanism for securing whipstock 200 in wellbore 100 is located proximate the torso 220 of whipstock 200. In some embodiments, the anchoring mechanism may trigger activation of the retraction actuator of retention system 400. For example, once the whipstock 200 is secured in the wellbore 100, a mechanical, hydraulic, acoustic, electromagnetic, optical, or other signal may be sent from the anchoring mechanism to activate the retraction actuator. In an exemplary embodiment, the piston 440 may be located proximate the anchoring mechanism so that the piston 440 is restricted from moving downwards in track 260 prior to the whipstock 200 being secured in wellbore 100. In some embodiments, the piston 440 may be a component of the anchoring mechanism.

Additional exemplary configurations of piston 440 are illustrated in FIG. 4C. Three different pistons 440', 440", and 440'" are illustrated together for comparison purposes. Typically, retention system 400 may include only one piston. Also, FIG. 4C illustrates BHA 300 slightly separated from whipstock 200. As illustrated, actuator extension 445' extends between piston 440' in track 260' and the retraction actuator (e.g., pin 430). Actuator extension 445' may be, for example, a rigid rod disposed in a channel 446' in whipstock 200. Track 260' may be a short track cut into the concave face 210 of whipstock 200. In some embodiments, track 260' may be cut through the entire thickness of whipstock 200, while in other embodiments, track 260' may be carved into concave face 210 without fully extending therethrough. In the illustration of FIG. 4C, piston 440" is located lower on whipstock 200 than piston 440'. As illustrated, actuator extension 445" extends between piston 440" and the retraction actuator (e.g., pin 430). Actuator extension 445" may be, for example, a hydraulic line disposed in a channel 446" in whipstock 200 and/or along the concave face 210 of whipstock 200. Track 260" may be a long track cut into a wall 211 (e.g., opposite side from concave face 210) of whipstock 200. In some embodiments, track 260" may be cut through the entire thickness of whipstock 200, while in other embodiments, track 260" may be carved into the wall 211 without fully extending therethrough. In the illustration of FIG. 4C, piston 440'" is located lower on whipstock 200 than piston 440". As illustrated, actuator extension 445'" extends between piston 440'" and the retraction actuator (e.g., pin 430). Actuator extension 445'" may be, for example, an electric wire disposed in a channel 446'" in whipstock 200. Track 260'" may be a short track integrated into the torso 220 of whipstock 200. The described features of piston 440', 440", 440'", track 260', 260", 260'", and actuator extension 445', 445", 445'" may be used interchangeably to meet manufacturing and/or operational specifications.

Figure 5A:
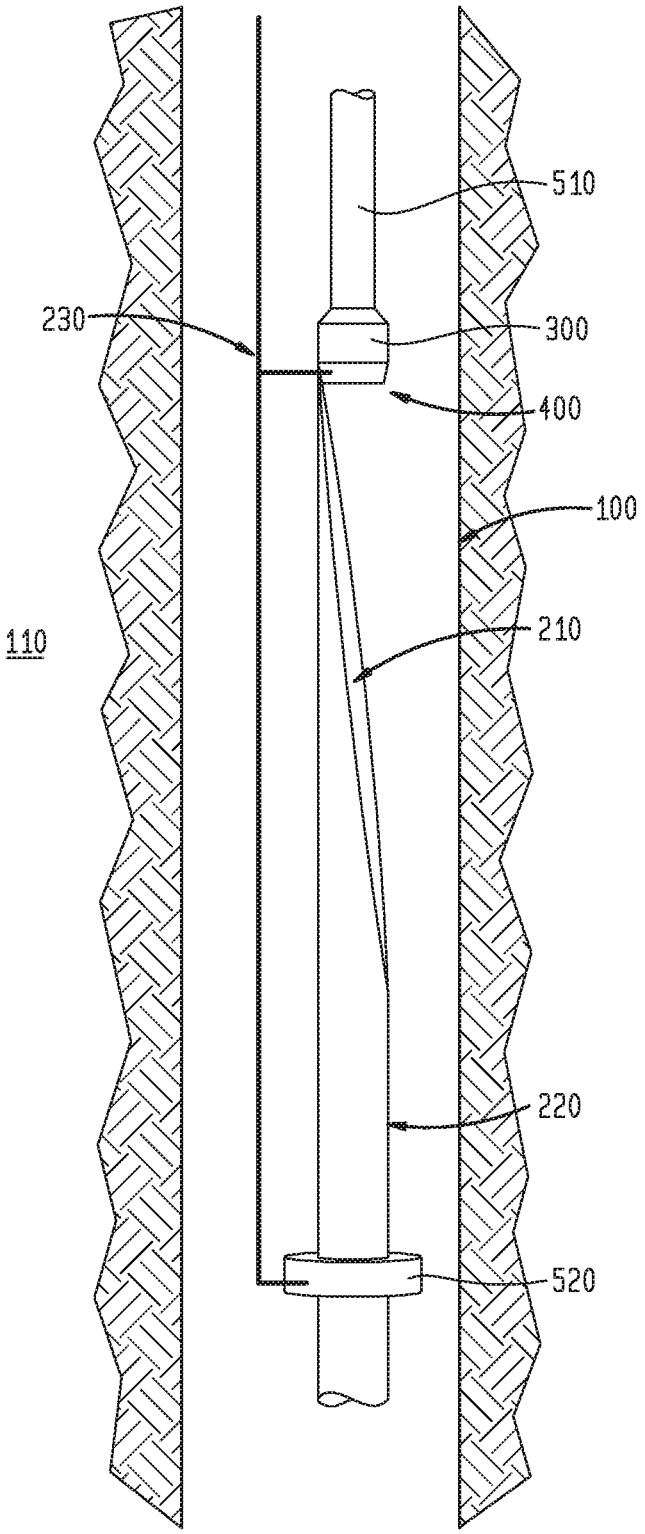
FIG. 5A illustrates an exemplary configuration of a whipstock having an anchoring mechanism and a retention system.

FIGS. 5A-5D illustrate several exemplary configurations of a whipstock 200 having an anchoring mechanism 520 and a retention system 400, according to embodiments disclosed herein. As illustrated in FIG. 5A, a BHA 300 is disposed at a lower end of a drill string 510 in wellbore 100. BHA 300 is mated with concave face 210 of whipstock 200 and secured thereto by retention system 400. An anchoring mechanism 520 is disposed proximate the torso 220 of whipstock 200. Control line 230 is operationally connected to both retention system 400 and anchoring mechanism 520. For clarity of illustration, control line 230 is set-apart from the other components in the wellbore 100, but it should be understood that control line 230 may be on or in any of the other components. For example, control line 230 may be a hydraulic control line extending along the outside of drill string 510, across BHA 300, and coupled to a piston 440 of retention system 400. Likewise, control line 230 may extend along the outside of whipstock 200 to couple with anchoring mechanism 520. Control line 230 may provide one or more control signals to retention system 400 and/or anchoring mechanism 520. For example, control line 230 may provide a first (lower) pressure signal to actuate anchoring mechanism 520 to secure whipstock 200 in wellbore 100. Control line 230 may then provide a second (higher) pressure signal to actuate retention system 400 (e.g., activate a retraction actuator and/or retract a retractable bolt 420 into a chamber 410 of BHA 300) to release BHA 300 from whipstock 200. Due to the difference in the pressure signals, control line 230 may signal retention system 400 to release BHA 300 from whipstock 200 only after whipstock 200 is secured in wellbore 100 by anchoring mechanism 520.

Figure 5B:
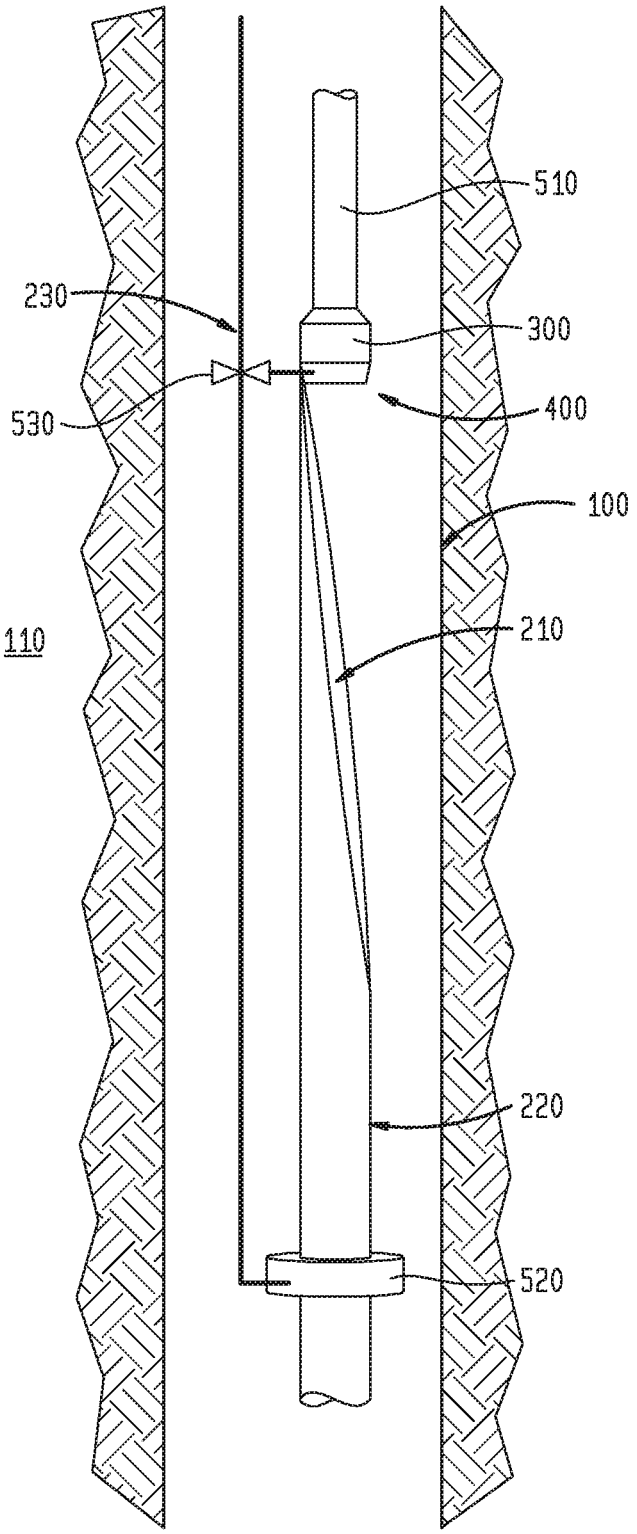
FIG. 5B illustrates another exemplary configuration of a whipstock having an anchoring mechanism and a retention system.

FIG. 5B illustrates another exemplary configuration of a whipstock 200 having an anchoring mechanism 520 and a retention system 400, according to embodiments disclosed herein. The configuration of FIG. 5B is similar to that of 5A, but a valve 530 is added in control line 230. As illustrated in FIG. 5B, valve 530 may determine whether control line 230 is operationally connected to retention system 400 or anchoring mechanism 520 at any point in time. Valve 530 may receive control signals separate from control line 230. For example, valve 530 may be electronically controlled. As another example, valve 530 may receive wireless control signals. Based on the setting(s) of valve 530, control line 230 may provide one or more control signals to retention system 400 and/or anchoring mechanism 520. For example, control line 230 may provide a first control signal to actuate anchoring mechanism 520 to secure whipstock 200 in wellbore 100. Valve 530 may then receive a control signal to switch control line 230 from operational connection with anchoring mechanism 520 to operational connection with retention system 400. Control line 230 may then provide a second control signal to actuate retention system 400 (e.g., activate a retraction actuator and/or retract a retractable bolt 420 into a chamber 410 of BHA 300) to release BHA 300 from whipstock 200. Due to the difference in operational connection based on the setting(s) of valve 530, control line 230 may signal retention system 400 to release BHA 300 from whipstock 200 only after whipstock 200 is secured in wellbore 100 by anchoring mechanism 520.

Figure 5C:
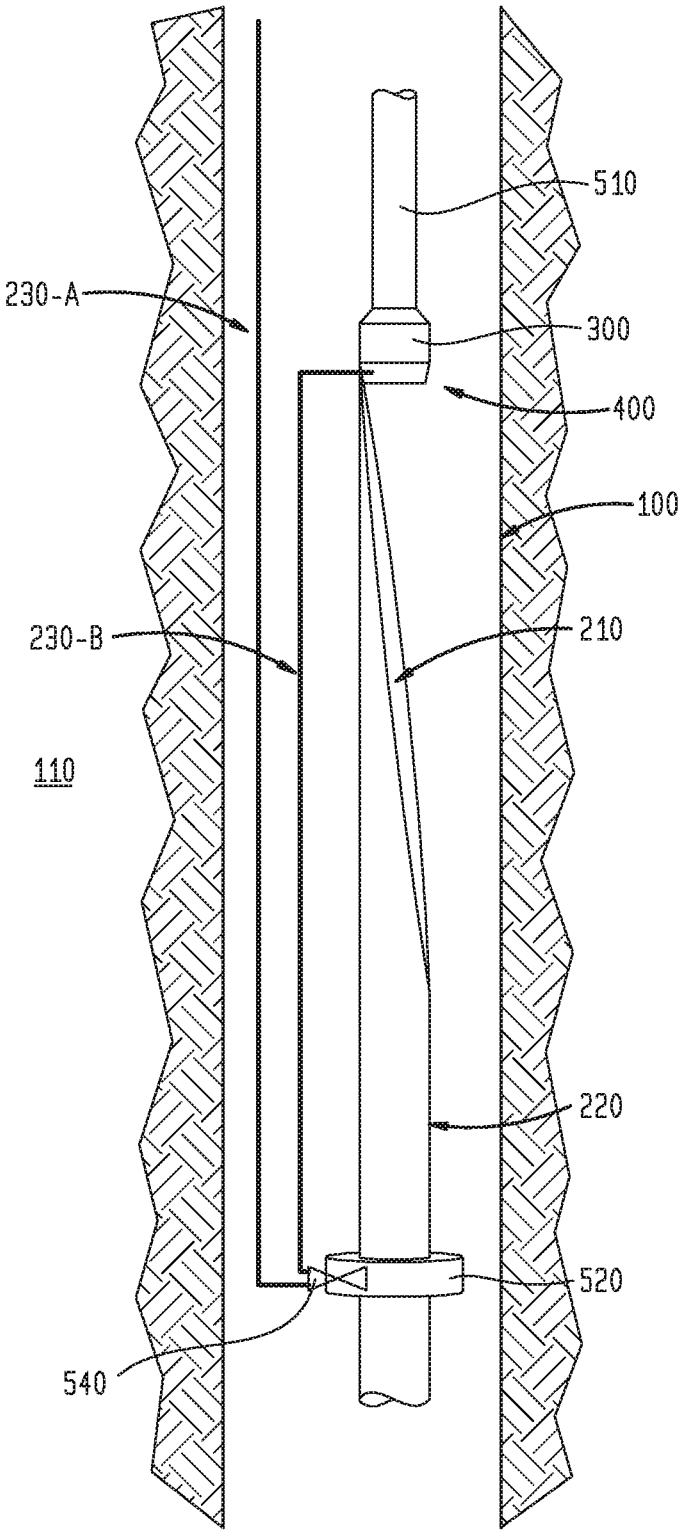
FIG. 5C illustrates another exemplary configuration of a whipstock having an anchoring mechanism and a retention system.

FIG. 5C illustrates another exemplary configuration of a whipstock 200 having an anchoring mechanism 520 and a retention system 400, according to embodiments disclosed herein. The configuration of FIG. 5C is similar to those of 5A and 5B, but an anchor valve 540 is added in anchoring mechanism 520 between first control line segment 230-A and second control line segment 230-B. As illustrated in FIG. 5C, anchor valve 540 may determine whether first control line segment 230-A is in communication with second control line segment 230-B, and thereby whether control line 230 is operationally connected to retention system 400 at any point in time. Anchor valve 540 may receive control signals separate from control line 230. For example, anchor valve 540 may be electronically controlled. As another example, anchor valve 540 may receive wireless control signals. As another example, the configuration of anchoring mechanism 520 may determine the setting(s) of anchor valve 540 (e.g., anchor valve 540 is closed unless and until anchoring mechanism has secured whipstock 200 in wellbore 100). Based on the setting(s) of anchor valve 540, second control line segment 230-B may provide one or more control signals to retention system 400. For example, first control line segment 230-A may provide a first control signal to actuate anchoring mechanism 520 to secure whipstock 200 in wellbore 100. Anchor valve 540 may then receive a control signal and/or assume a configuration to open communication between first control line segment 230-A and second control line segment 230-B. Second control line segment 230-B may then provide a second control signal to actuate retention system 400 (e.g., activate a retraction actuator and/or retract a retractable bolt 420 into a chamber 410 of BHA 300) to release BHA 300 from whipstock 200. Due to the difference in operational connection based on the setting(s) of anchor valve 540, second control line segment 230-B may signal retention system 400 to release BHA 300 from whipstock 200 only after whipstock 200 is secured in wellbore 100 by anchoring mechanism 520.

Figure 5D:
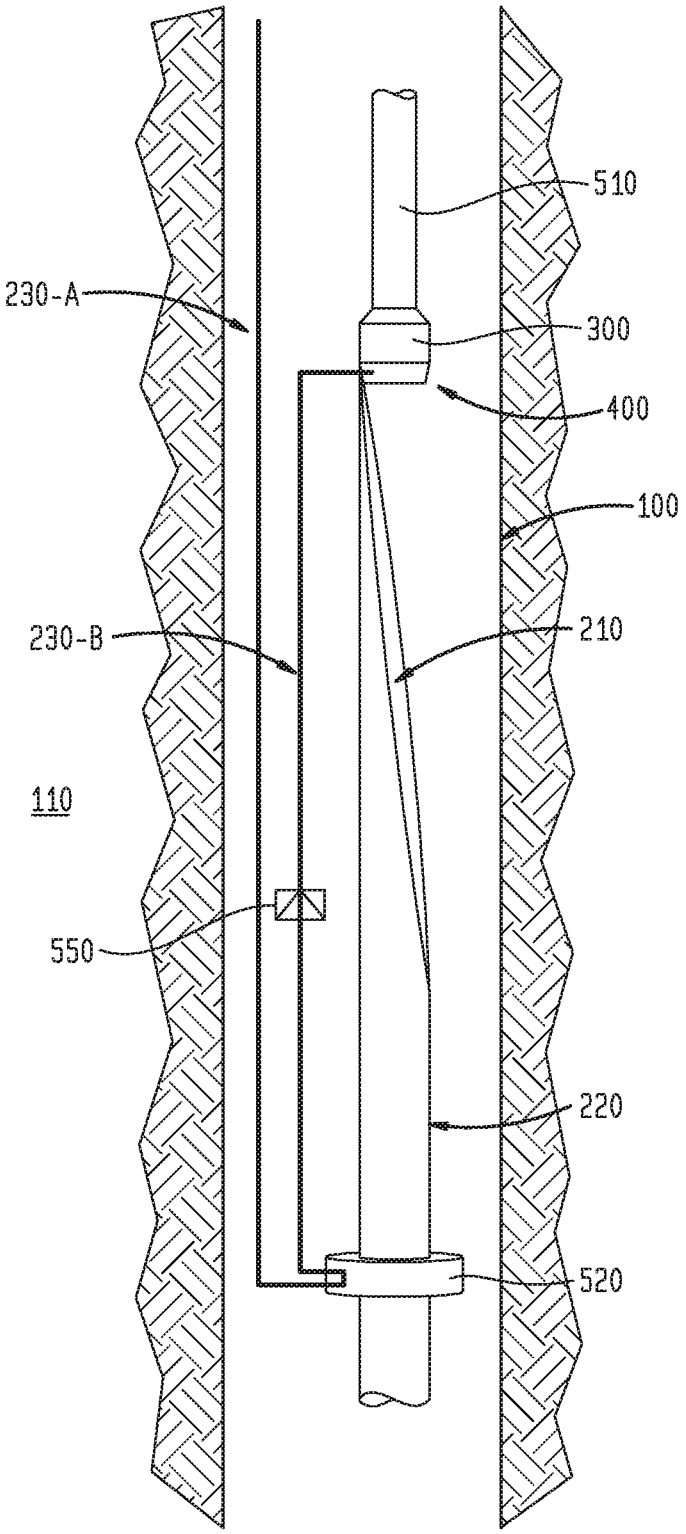
FIG. 5D illustrates another exemplary configuration of a whipstock having an anchoring mechanism and a retention system.

FIG. 5D illustrates another exemplary configuration of a whipstock 200 having an anchoring mechanism 520 and a retention system 400, according to embodiments disclosed herein. The configuration of FIG. 5D is similar to those of 5A, 5B, and 5C, but a barrier (e.g., a rupture disk 550) is added in second control line segment 230-B. As illustrated in FIG. 5D, first control line segment 230-A is in communication with second control line segment 230-B through anchoring mechanism 520. However, rupture disk 550 may determine whether second control line segment 230-B communications are opened or closed, and thereby whether second control line segment 230-B is operationally connected to retention system 400 at any point in time. The rating of rupture disk 550 is selected so that any and all control signals provided to operate anchoring mechanism 520 (through control line segment 230-A) do not open communications through rupture disk 550. When rupture disk 550 is opened, second control line segment 230-B may provide one or more control signals to retention system 400. For example, first control line segment 230-A may provide a first control signal to actuate anchoring mechanism 520 to secure whipstock 200 in wellbore 100. Rupture disk 550 may then receive a control signal (e.g., pressure signal above rating) to open communication in second control line segment 230-B. Second control line segment 230-B may then provide a second control signal to actuate retention system 400 (e.g., activate a retraction actuator and/or retract a retractable bolt 420 into a chamber 410 of BHA 300) to release BHA 300 from whipstock 200. Due to the difference in operational connection based on the state of rupture disk 550, second control line segment 230-B may signal retention system 400 to release BHA 300 from whipstock 200 only after whipstock 200 is secured in wellbore 100 by anchoring mechanism 520.

A person of ordinary skill in the art with the benefit of this disclosure may envision numerous other control configurations that provide actuation of retention system 400 only after anchoring mechanism 520 has secured whipstock 200 in wellbore 100. The retraction actuator of retention system 400 may be activated by a control signal (e.g., from control line 230), which may include one or more of a hydraulic signal (e.g., hydraulic piston 440), a pneumatic signal, an electromagnetic signal (e.g., a solenoid), an optical signal, a chemical signal (e.g., to dissolve pin 430), a time-based signal (e.g., an auto-dissolving pin), a thermal signal, an explosive signal, etc. In some embodiments, uphole axial load and/or downhole axial load may be applied to drill string 510 to confirm that whipstock 200 is secured in wellbore 100 before a control signal is sent to retention system 400. In some embodiments, sensors may detect the orientation of concave face 210 in wellbore 100 and/or the position of torso 220 in wellbore 100 to confirm that whipstock 200 is correctly oriented and/or positioned in wellbore 100 before a control signal is sent to retention system 400.

In an embodiment, a retention system for a bottom hole assembly and a whipstock includes: a bias mechanism; a retractable bolt at least partially disposed in the bottom hole assembly and biased to a retracted position by the bias mechanism, wherein the retractable bolt moves without destruction during operation; and a retraction actuator capable of selectably opposing the bias of the retractable bolt.

In one or more embodiments disclosed herein, the retention system also includes meshing features on the bottom hole assembly and the whipstock, wherein the meshing features slideably mesh and slideably release without rotation between the bottom hole assembly and the whipstock.

In one or more embodiments disclosed herein, the meshing features comprise at least one of a blade, a water channel, a dog, and a hole.

In one or more embodiments disclosed herein, the meshing features comprise at least one torsional load surface.

In one or more embodiments disclosed herein, the retention system also includes a control line, wherein the retraction actuator is activated by a control signal from the control line.

In one or more embodiments disclosed herein, the bias mechanism comprises at least one of a spring, a magnet, and a shaped memory alloy.

In one or more embodiments disclosed herein, a shape of the retractable bolt comprises at least one of a pin, a plate, and a fork.

In one or more embodiments disclosed herein, the retraction actuator comprises at least one of a hydraulic actuator, a pneumatic actuator, an electromagnetic actuator, a pin, a piston, and an actuator extension.

In an embodiment, a retention system for a bottom hole assembly and a whipstock includes: a retractable bolt at least partially disposed in the bottom hole assembly; a retraction actuator capable of selectably opposing a retraction force on the retractable bolt; and meshing features on the bottom hole assembly and the whipstock, wherein the meshing features slideably mesh and slideably release without rotation between the bottom hole assembly and the whipstock.

In one or more embodiments disclosed herein, the retractable bolt moves without destruction during operation.

In one or more embodiments disclosed herein, the meshing features comprise at least one of a blade, a water channel, a dog, and a hole.

In one or more embodiments disclosed herein, the meshing features comprise at least one torsional load surface.

In one or more embodiments disclosed herein, the retractable bolt and the bottom hole assembly are configured to create a pressure differential to produce the retraction force.

In one or more embodiments disclosed herein, the retention system also includes a control line, wherein the retraction actuator is activated by a control signal from the control line.

In one or more embodiments disclosed herein, a shape of the retractable bolt comprises at least one of a pin, a plate, and a fork.

In one or more embodiments disclosed herein, the retraction actuator comprises at least one of a hydraulic actuator, a pneumatic actuator, an electromagnetic actuator, a pin, a piston, and an actuator extension.

In an embodiment, a downhole system includes: a whipstock; a bottom hole assembly proximate a lower end of a drill string; and a retention system, wherein: when the downhole system is in a first operational configuration, the retention system secures the whipstock to the bottom hole assembly with an axial load coupling component and a torsional load coupling component; when the downhole system is in a second operational configuration, the retention system secures the whipstock to the bottom hole assembly with the torsional load coupling component, but not the axial load coupling component; and when the downhole system is in a third operational configuration, the retention system does not secure the whipstock to the bottom hole assembly.

In one or more embodiments disclosed herein, the retention system comprises a retraction actuator comprising at least one of a hydraulic actuator, a pneumatic actuator, an electromagnetic actuator, a pin, a piston, and an actuator extension.

In one or more embodiments disclosed herein, the retention system further comprises a retractable bolt that is biased to a retracted position.

In one or more embodiments disclosed herein, a shape of the retractable bolt comprises at least one of a pin, a plate, and a fork.

In one or more embodiments disclosed herein, prior to actuation, the retraction actuator holds the retractable bolt in an extended position.

In one or more embodiments disclosed herein, the retractable bolt is in an extended position when the downhole system is in the first operational configuration, and the retractable bolt is in the retracted position when the downhole system is in the second operational configuration and the third operational configuration.

In one or more embodiments disclosed herein, the retractable bolt is not sheared in any of the first, second, or third operational configurations.

In one or more embodiments disclosed herein, in the first operational configuration and in the second operational configuration, the torsional load coupling component is capable of transferring downhole axial load from the drill string to the whipstock.

In one or more embodiments disclosed herein, in the first operational configuration, the axial load coupling component is capable of transferring both uphole and downhole axial load from the whipstock to the drill string.

In one or more embodiments disclosed herein, the bottom hole assembly comprises a mill face having recesses; the torsional load coupling component comprises at least two protrusions on the whipstock; and in the first operational configuration and in the second operational configuration, the at least two protrusions are disposed in a portion of the recesses.

In one or more embodiments disclosed herein, in the first operational configuration and in the second operational configuration, a first and a second of the at least two protrusions are disposed in a first and a second of the recesses, respectively; and a length of the first protrusion is not parallel to a length of the second protrusion.

In one or more embodiments disclosed herein, in the third operational configuration, the at least two protrusions are downhole from the mill face.

In one or more embodiments disclosed herein, the downhole system also includes an anchoring mechanism for securing the whipstock in a wellbore.

In one or more embodiments disclosed herein, actuation of the retention system is dependent upon actuation of the anchoring mechanism.

In one or more embodiments disclosed herein, the downhole system also includes a control line configured to actuate the retention system only after actuation of the anchoring mechanism.

In an embodiment, a method of milling a casing includes: coupling a whipstock to a bottom hole assembly with a retention system, the retention system including: a retractable bolt biased to retract into the bottom hole assembly; and a retraction actuator configured to resist the bias of the retractable bolt; and after the whipstock and the bottom hole assembly have been disposed in a wellbore, activating the retraction actuator so that a retraction of the retractable bolt ensues.

In one or more embodiments disclosed herein, the method also includes securing the whipstock in the wellbore before activating the retraction actuator.

In one or more embodiments disclosed herein, the method also includes orienting and positioning the whipstock in the wellbore before securing the whipstock in the wellbore.

In one or more embodiments disclosed herein, the method also includes sending at least one control signal to secure the whipstock in the wellbore and to activate the retraction actuator.

In one or more embodiments disclosed herein, coupling the whipstock to the bottom hole assembly comprises engaging recesses of a mill face of the bottom hole assembly with protrusions of the whipstock, the method further comprising moving the bottom hole assembly uphole from the secured whipstock, thereby disengaging the recesses of the mill face from the protrusions.

In one or more embodiments disclosed herein, the method also includes slideably releasing without relative rotation the bottom hole assembly from the whipstock.

In one or more embodiments disclosed herein, the method also includes milling the casing in the wellbore with the bottom hole assembly.

In one or more embodiments disclosed herein, the retractable bolt moves without destruction during the retraction.

In one or more embodiments disclosed herein, the retention system further comprises a bias mechanism, the method further comprising applying a retraction force on the retractable bolt with the bias mechanism.

In an embodiment, a method of milling a casing includes: coupling a whipstock to a bottom hole assembly, the bottom hole assembly having a retractable bolt, the coupling comprising: engaging recesses of a mill face of the bottom hole assembly with protrusions of the whipstock; and selectably opposing a retraction of the retractable bolt; and activating the retraction of the retractable bolt after the whipstock and the bottom hole assembly have been disposed in a wellbore, wherein the retractable bolt moves without destruction during the retraction.

In one or more embodiments disclosed herein, the method also includes securing the whipstock in the wellbore before activating the retraction.

In one or more embodiments disclosed herein, the method also includes orienting and positioning the whipstock in the wellbore before securing the whipstock in the wellbore.

In one or more embodiments disclosed herein, the method also includes moving the bottom hole assembly uphole from the secured whipstock, thereby disengaging the recesses of the mill face from the protrusions.

In one or more embodiments disclosed herein, the method also includes sending control signals to secure the whipstock in the wellbore and activate the retraction actuator.

In one or more embodiments disclosed herein, the method also includes slideably releasing without relative rotation the bottom hole assembly from the whipstock.

In one or more embodiments disclosed herein, the method also includes applying a retraction force on the retractable bolt.

In one or more embodiments disclosed herein, the retraction force comprises a pressure differential across the retractable bolt.

In an embodiment, a method of assembling a downhole system includes: attaching a plurality of protrusions to a concave face of a whipstock of the downhole system, wherein: the plurality of protrusions are configured to slideably mesh and slideably release without relative rotation with recesses in a mill face of a bottom hole assembly of the downhole system; and at least two of the plurality of protrusions are at opposing angles to one another.

In one or more embodiments disclosed herein, the method also includes constructing a hole in the whipstock and a chamber in the bottom hole assembly, wherein the hole and the chamber align when the whipstock is meshed with the bottom hole assembly.

In one or more embodiments disclosed herein, the method also includes installing a bolt and a bias mechanism in the chamber.

While the foregoing is directed to embodiments of the present disclosure, other and further embodiments of the disclosure may be devised without departing from the basic scope thereof, and the scope thereof is determined by the claims that follow.

The invention claimed is:

1. A retention system for a bottom hole assembly and a whipstock comprising:

a bias mechanism;

a retractable bolt at least partially disposed in the bottom hole assembly and biased to a retracted position by the bias mechanism, wherein the retractable bolt moves without destruction during operation; and a retraction actuator at least partially disposed within the whipstock, the retraction actuator capable of selectably opposing the bias of the retractable bolt.

2. The retention system of claim 1, further comprising meshing features on the bottom hole assembly and the whipstock, wherein the meshing features slideably mesh and slideably release without rotation between the bottom hole assembly and the whipstock.

3. The retention system of claim 2, wherein the meshing features comprise at least one of a blade, a water channel, a dog, and a hole.

4. The retention system of claim 2, wherein the meshing features comprise at least one torsional load surface.

5. The retention system of claim 1, further comprising a control line, wherein the retraction actuator is activated by a control signal from the control line.

6. The retention system of claim 1, wherein the bias mechanism comprises at least one of a spring, a magnet, and a shaped memory alloy.

7. The retention system of claim 1, wherein a shape of the retractable bolt comprises at least one of a pin, a plate, and a fork.

8. The retention system of claim 1, wherein the retraction actuator comprises at least one of a hydraulic actuator, a pneumatic actuator, an electromagnetic actuator, a pin, a piston, and an actuator extension.

9. A retention system for a bottom hole assembly and a whipstock comprising:

a retractable bolt at least partially disposed in the bottom hole assembly;

a retraction actuator capable of selectably opposing a retraction force on the retractable bolt; and meshing features on the bottom hole assembly and the whipstock, wherein the meshing features slideably mesh and slideably release without rotation between the bottom hole assembly and the whipstock.

10. The retention system of claim 9, wherein the retractable bolt moves without destruction during operation.

11. The retention system of claim 9, wherein the meshing features comprise at least one of a blade, a water channel, a dog, and a hole.

12. The retention system of claim 9, wherein the meshing features comprise at least one torsional load surface.

13. The retention system of claim 9, wherein the retractable bolt and the bottom hole assembly are configured to create a pressure differential to produce the retraction force.

14. The retention system of claim 9, further comprising a control line, wherein the retraction actuator is activated by a control signal from the control line.

15. The retention system of claim 9, wherein a shape of the retractable bolt comprises at least one of a pin, a plate, and a fork.

16. The retention system of claim 9, wherein the retraction actuator comprises at least one of a hydraulic actuator, a pneumatic actuator, an electromagnetic actuator, a pin, a piston, and an actuator extension.

17. A method of milling a wall in a wellbore comprising:

coupling a whipstock to a bottom hole assembly with a retention system, the retention system comprising:

a retractable bolt biased to retract into the bottom hole assembly; and a retraction actuator configured to resist the bias of the retractable bolt;

after the whipstock and the bottom hole assembly have been disposed in the wellbore, activating the retraction actuator so that a retraction of the retractable bolt ensues; and milling the wall in the wellbore using the bottom hole assembly.

18. The method of claim 17, further comprising securing the whipstock in the wellbore before activating the retraction actuator.

19. The method of claim 18, further comprising orienting and positioning the whipstock in the wellbore before securing the whipstock in the wellbore.

20. The method of claim 18, further comprising sending at least one control signal to secure the whipstock in the wellbore and to activate the retraction actuator.

21. The method of claim 18, wherein coupling the whipstock to the bottom hole assembly comprises engaging recesses of a mill face of the bottom hole assembly with protrusions of the whipstock, the method further comprising moving the bottom hole assembly uphole from the secured whipstock, thereby disengaging the recesses of the mill face from the protrusions.

22. The method of claim 17, further comprising slideably releasing without relative rotation the bottom hole assembly from the whipstock.

23. The method of claim 17, wherein the retractable bolt moves without destruction during the retraction.

24. The method of claim 17, wherein the retention system further comprises a bias mechanism, the method further comprising applying a retraction force on the retractable bolt with the bias mechanism.

25. The method of claim 17, wherein the wall is part of a casing.

26. A method of milling a casing comprising:

coupling a whipstock to a bottom hole assembly, the bottom hole assembly having a retractable bolt, the coupling comprising:

engaging recesses of a mill face of the bottom hole assembly with protrusions of the whipstock;

applying a retraction force to the retractable bolt; and using a retraction actuator to selectively oppose the retraction force on the retractable bolt; and activating the retraction of the retractable bolt after the whipstock and the bottom hole assembly have been disposed in a wellbore, wherein the retractable bolt moves without destruction during the retraction.

27. The method of claim 26, further comprising securing the whipstock in the wellbore before activating the retraction.

28. The method of claim 27, further comprising orienting and positioning the whipstock in the wellbore before securing the whipstock in the wellbore.

29. The method of claim 27, further comprising moving the bottom hole assembly uphole from the secured whipstock, thereby disengaging the recesses of the mill face from the protrusions.

30. The method of claim 27, further comprising sending control signals to secure the whipstock in the wellbore and activate a retraction actuator.

31. The method of claim 26, further comprising slideably releasing without relative rotation the bottom hole assembly from the whipstock.

32. The method of claim 26, further comprising applying a retraction force on the retractable bolt.

33. The method of claim 32, wherein the retraction force comprises a pressure differential across the retractable bolt.

34. The method of claim 26, wherein the protrusions are configured to transfer an axial load from the bottom hole assembly to the whipstock.

* * * * *